US005738364A

United States Patent [19]

Zotter et al.

[11] Patent Number: 5,738,364

[45] Date of Patent: Apr. 14, 1998

[54] SKI BINDING

[75] Inventors: Johann Zotter, Vienna; Friedrich Leichtfried, Traiskirchen; Klaus Hoelzl, Vienna; Henry Freisinger, Vienna; Alois Himmetsberger, Vienna; Reinhold Wawra, Vienna; Hubert Wuerthner, Hainburg/Donau, all of Austria

[73] Assignee: HTM Sport- und Freizeitgeraete Aktiengesellschaft, Schwechat, Austria

[21] Appl. No.: 591,648

[22] PCT Filed: May 19, 1995

[86] PCT No.: PCT/EP95/01900

§ 371 Date: Jan. 29, 1996

§ 102(e) Date: Jan. 29, 1996

[87] PCT Pub. No.: WO95/32772

PCT Pub. Date: Dec. 7, 1995

[30] Foreign Application Priority Data

May 30, 1994 [AT] Austria ..... 1099/94

[51] Int. Cl.[6] ..... A63C 9/084

[52] U.S. Cl. ..... 280/633

[58] Field of Search ..... 280/633, 607, 280/617, 634, 636; 441/70

[56] References Cited

U.S. PATENT DOCUMENTS

| | | | |
|---|---|---|---|
| 4,522,424 | 6/1985 | Luitz et al. | 280/633 |
| 5,056,809 | 10/1991 | Brischoux et al. | 280/633 X |
| 5,096,218 | 3/1992 | Bardin | 280/633 |
| 5,209,516 | 5/1993 | Arduin et al. | 280/633 |
| 5,628,526 | 5/1997 | Zotter et al. | 280/633 |

FOREIGN PATENT DOCUMENTS

| | | |
|---|---|---|
| 2175139 | 10/1973 | France . |
| 2368974 | 5/1978 | France . |
| 2638653 | 5/1990 | France . |
| 09870 | 5/1994 | WIPO . |

*Primary Examiner*—Brian L. Johnson
*Assistant Examiner*—Michael Mar
*Attorney, Agent, or Firm*—Flynn, Thiel, Boutell & Tanis, P.C.

[57] ABSTRACT

A ski binding in which a heel part can be adjusted in the longitudinal direction relative to a guide fixed to a ski and can be actuated by hand. In order to prevent the connecting web of the opening lever disengaging from the locking plate s well as involuntary unlatching of the heel part due to external influences, the invention provides that the connecting web of the opening lever is designed in a U-shaped manner, and that the connecting web, bent in the direction of the upper side of the ski, forms protecting web which terminates flush with the guide fixed to a ski. A restoring lug assists the function of the spring, which acts on the locking piece, the restoring lug being actuable, by way of an edge of the connecting web, by pulling on the opening lever and being formed by being bent out of the locking plate.

4 Claims, 3 Drawing Sheets

SKI BINDING

FIELD OF THE INVENTION

The invention presents an improvement to a ski binding which is known from the document WO94/09870 and in which a heel part can be adjusted in the longitudinal direction relative to a guide fixed to a ski and can be secured in predetermined variable sections. Provided, in this arrangement, on a locking piece are latching means which can be engaged with, and disengaged from, mating latching means of a guide fixed to a ski.

BACKGROUND OF THE INVENTION

In this arrangement, a connecting arm engages beneath the locking piece at its rear end section, which is arranged in a freely accessible manner at the rear part of the ski binding.

When a ski boot is inserted, the heel part slides further rearwards in the guide, with further compression of a spring which acts on the locking piece. This means that there is the possibility, in extreme positions, of the locking plate and the connecting arm being disengaged from one another, this resulting in the risk of it no longer being possible to carry out a longitudinal adjustment by hand.

The action of the spring which acts on the locking piece may be obstructed by dirt or the like.

It is, then, the object of the invention to provide a ski binding which permits rapid and simple adjustment of the heel part relative to the guide fixed to a ski, the intention being for it to be possible to carry out the unlatching operation, without tools and with a low amount of force, even by exerting pressure with only one hand. Furthermore, it is intended to provide a protection device which prevents involuntary release of the latching, e.g. by a ski pole, and there is the additional intention of providing means for, if necessary, assisting the function of the spring which acts on the locking piece.

It is likewise intended to ensure a configuration which rules out the situation where the locking plate becomes disengaged from the connecting web.

SUMMARY OF THE INVENTION

The object set is achieved according to the invention by the designing a connecting arm in a U-shaped manner, said arm providing the bent region of the locking plate with a lengthened contact surface, in the case of the heel part being displaced longitudinally counter to the force of the spring. A protecting support portion which prevents involuntary unlatching due to external influences is formed by the connecting arm being bent in the direction of the upper side of the ski.

The action of the spring is assisted, in the case of, for example, dirt, in that a restoring arm is bent out of the locking plate and, if required, deliberate pulling on the opening lever can exert an additional pressure on said restoring arm, this additional pressure permits a latching operation.

BRIEF DESCRIPTION OF THE DRAWINGS

The invention, together with the advantages thereof, is explained hereinbelow by way of exemplary embodiments, with reference to the drawings, in which.

DETAILED DESCRIPTION

Figure 1:
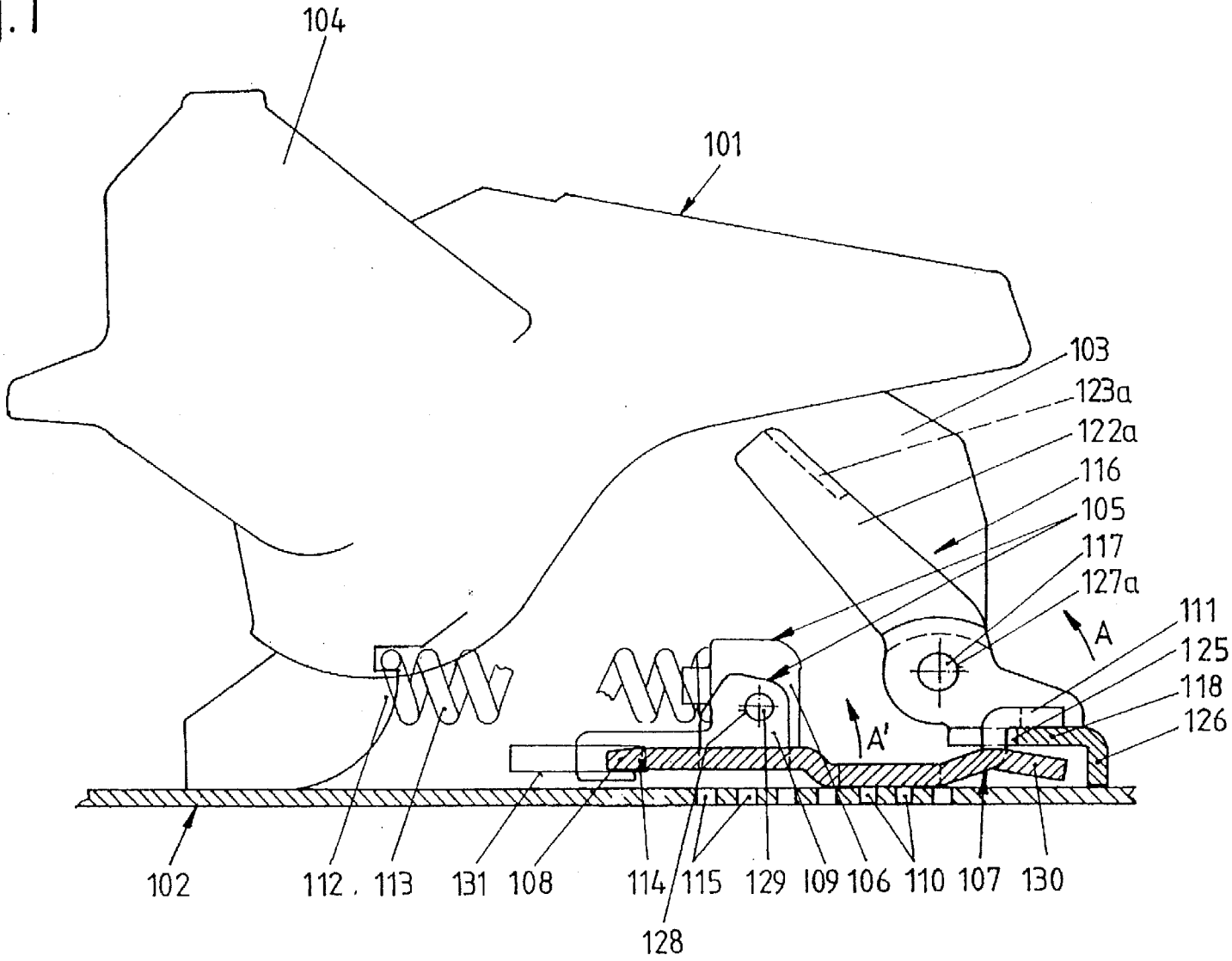
FIG. 1 shows a schematic side view, partly in section, of a ski binding according to the invention, with the locking piece latched into a guide fixed to a ski.

According to FIG. 1, the heel part 101 of a ski binding is positioned along a guide 102 fixed to a ski, e.g. screwed onto a ski.

The heel part 101 comprises a housing 103 and a sole-retaining means 104 which can be pivoted with respect to the housing and can be latched in and released under specific force conditions.

The intention is that the heel part 101 depending on the boot size - can be latched releasably in various positions relative to the guide 102. For this purpose, a locking piece 105 is provided within the housing 103, which locking piece has a bearing and spring-guiding body 106 and a locking plate 107. The latter can be seen more clearly from FIGS. 3, 3*a* and 3*b*.

At its front end, the locking plate 107, which is produced, for example, by being stamped out of metal, exhibits two lateral bearing supports 108. Two side walls 109 project upward approximately at right angles from the locking plate 107.

Further toward the rear, small latching lugs 110, of which there are four in the present case, project from the underside of the locking plate 107. At its rear end section, the locking plate 107 has an upwardly extending bent portion 111. The bearing and spring-guiding body 106 is connected rigidly to the locking plate 107 by a pin 129, which is received into the bores 128 of the side walls 109.

Figure 2:
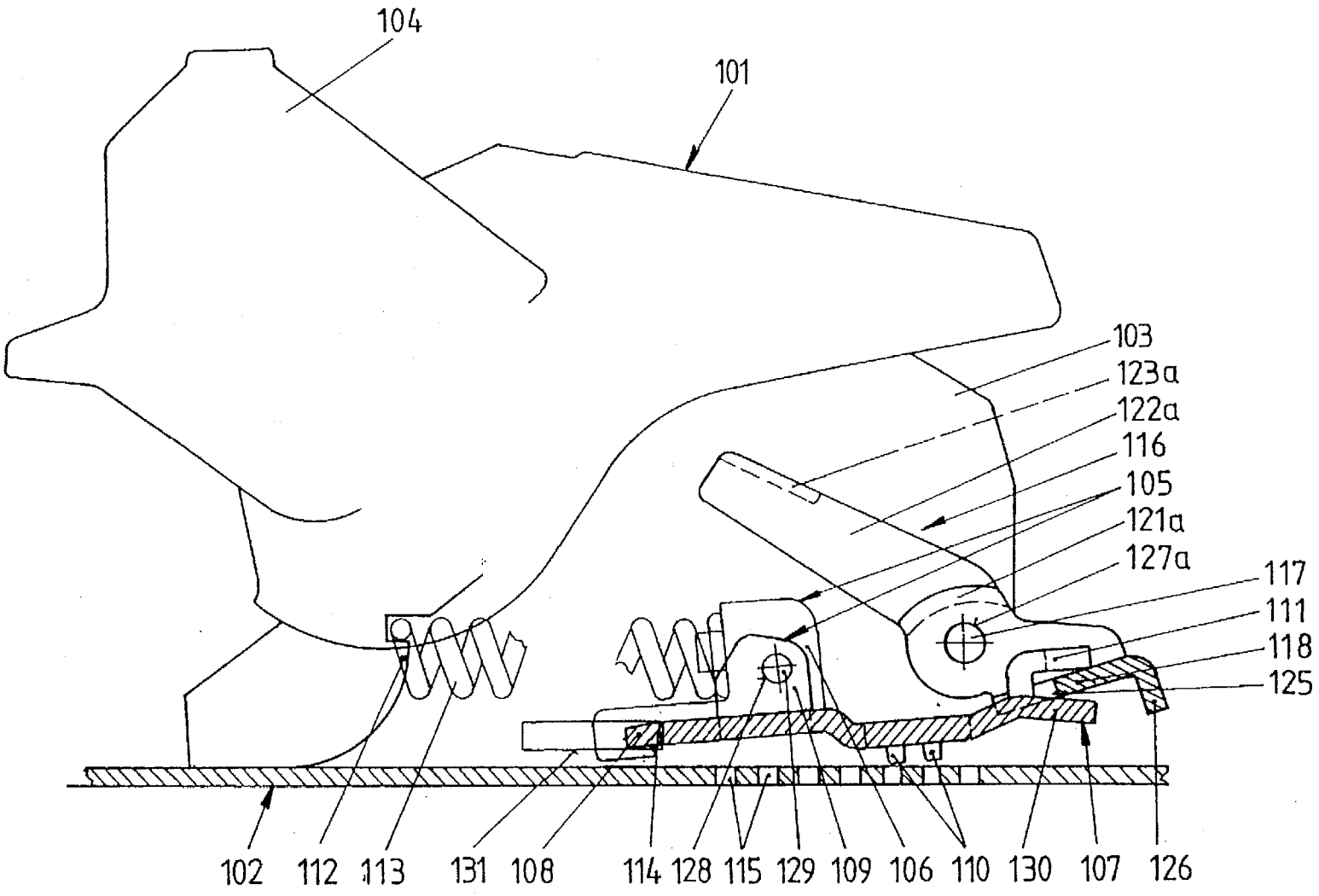
FIG. 2 shows the binding in a view as in FIG. 1, but with the locking piece unlatched.

The entire locking piece 105 is inserted into the housing 103 in the manner shown in FIGS. 1 and 2. Acting between the bearing and spring-guiding body 106 and a spring-supporting means 112 fixed to the housing is a compression spring 113 which forces the locking piece 105 rearward, the two bearing supports 108 each being supported on a stop 114 of a guide 131 affixed to the housing, and preventing any further rearward movement of the locking plate 107. Since the compression spring 113 acts above the stops 114 of the guide 131, the locking piece 105 is also subjected to a movement in the clockwise direction in the drawing. In this arrangement, the latching lugs 110 are received into latching holes 115 which are made in two mutually parallel rows in the guide 102 fixed to a ski.

In addition to the task of keeping the locking piece 105 in its latched-in position, the spring 113 also has the task of pressing the heel part 101 against a boot which has been inserted into the binding. When a boot is inserted, the heel part 101 thus slides further rearwards in the guide 102, with Simultaneous further compression of the compression spring 113. In order to avoid the situation where a connecting arm 118 of an opening lever 116, which will be described in more detail below, is disengaged from the locking plate 107 during this horizontal movement, the connecting arm 118 is advantageously designed in a U-shaped manner when viewed in a plan view.

In order to adapt the binding to a differently sized boot, the heel part 101 is usually adjusted with respect to the guide 102 fixed to a ski. For this purpose, the locking piece 105 has to be unlatched and relatched in a new position.

Figure 3:
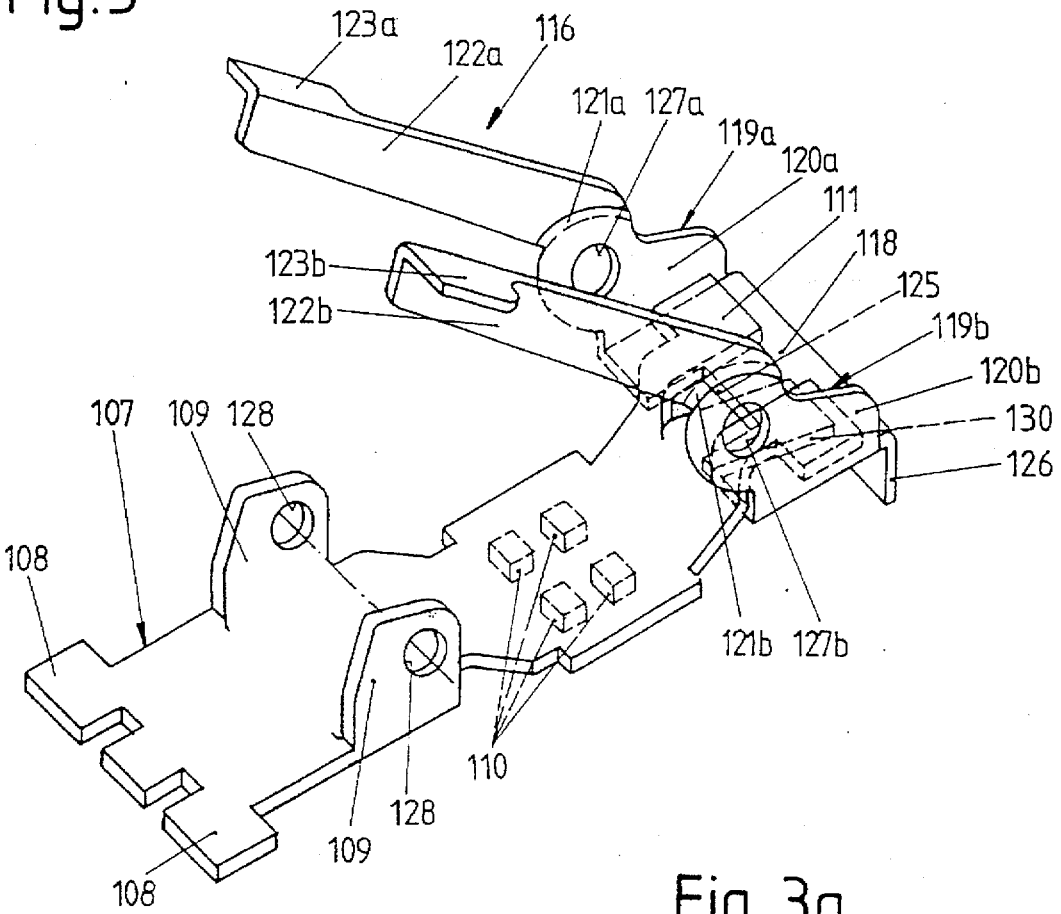
FIG. 3 shows a graphical representation of the locking piece and the opening lever acting thereon.

In the present case, an opening lever 116 is provided for this purpose, the clearest illustration of the opening lever being given in FIG. 3. Said lever 116 is, in kinematic terms, two-legged and is articulated at a bearing point 117 fixed to the housing, e.g. by means of rivets which pass through bores 127*a*, 127*b* of the opening lever 116. As seen from the rear (or from the front), the opening lever 116 is designed in an essentially U-shaped manner, and the connecting arm 118 of its two legs 119*a*, 119*b* is located beneath the bent portion 111 of the locking plate 107 and acts thereon. First leg sections 120*a*, 120*b* extend upward from the connecting arm 118 to the abovementioned bearing point 117 on the housing 103. Each of the leg sections 120*a*, 120*b* have an outwardly directed bent portion 121*a*, 121*b* and then, angled off forward, merge into second leg sections 122*a*, 122*b*, which extend essentially parallel to the first leg sections 120*a*, 120*b*. At its free end section, each of the forward-extending second leg sections 122*a*, 122*b* bears an outwardly projecting handle extension 123*a*, 123*b*.

In order to temporarily release the latching of the locking piece 105 and of the locking plate 107 to the guide 102, one takes hold of the heel part 101 from above, grips the handle extensions 123*a*, 123*b* of the two legs 119*a*, 119*b*, for example with the thumb and middle finger, and forces the second sections 122*a*, 122*b* of said legs downward, this resulting in the lever 116 pivoting (in the counter-clockwise direction) in the direction of the arrow A. In this arrangement, the connecting arm 118 acts, with its upper surface, on the bent portion 111 or on the underside thereof, and raises the rear end of the locking plate 107, as a result of which the latching lugs 110 are lifted out of the latching holes 115 of the guide 102. The locking plate 107 pivots, with its bearing supports 108 (likewise in the counter-clockwise direction in the drawing) in the guides 131 fixed to the housing, in the direction of the opening lever, designated here by arrow A'.

In the unlatched position represented in FIG. 2, the heel part 101 can be displaced forward or rearward into the desired new position. After the opening lever 116 has been released and, if appropriate, the heel part 101 has been displaced slightly, the latching lugs 110 latch into the desired new latching holes 115.

Should the locking piece 105, for whatever reason, e.g. due to dirt, be sluggish, thus preventing the possibility of it being pivoted into a latched position by the force of the spring 113 alone, then the edge 125 of the connecting arm 118 of the opening lever 116 acts on the restoring lug 130 of the locking plate 107 and forces the locking piece 105 into a latched position. The supporting and protecting web 126 of the opening lever 116, which is formed by an extension of the connecting arm 118, terminates flush with the guide 102 fixed to a ski, when the locking piece 105 is in the latched position, as a result of which involuntary release due to external influences, e.g. by a ski pole, is prevented.

Figure 3A:
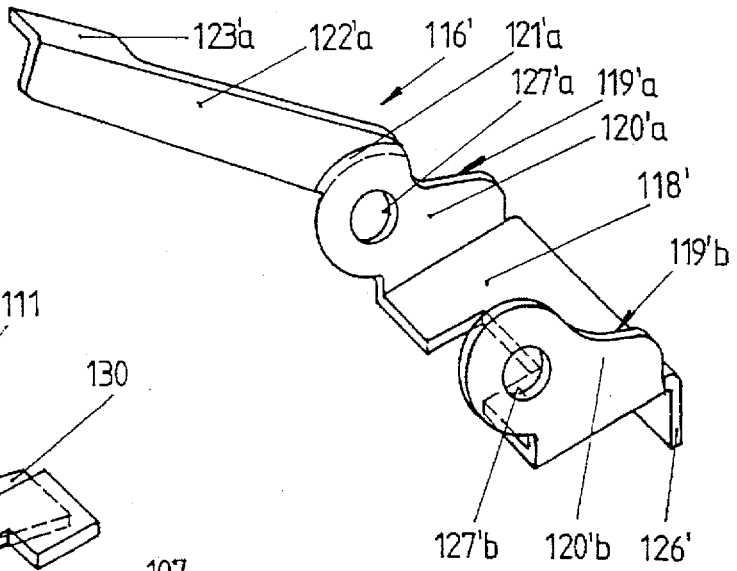
FIG. 3*a* shows a modification of the opening lever.
Figure 3B:
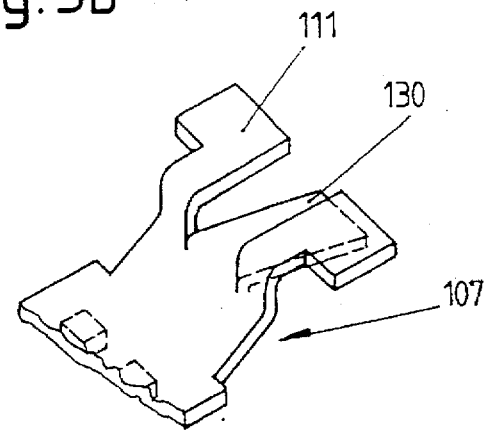
FIG. 3*b* shows the end section of the locking plate with a bent-out restoring arm.

As is illustrated in FIG. 3*a*, it is also possible for the opening lever 116' to have the bent portion 121'*a* and a front leg section 122'*a* with a handle extension 123'*a* only on one side, only the first leg section 120'*b* being provided on the other side. FIG. 3*a* shows bores 127*a*, 127*b* which are formed in the first leg sections 120'*a*, 120'*b*. By means of rivets or the like (not shown) which extend through said bores 127'*a*, 127'*b*, the lever 116' can be mounted rotatably on the housing 103, as has already been described in the first exemplary embodiment.

The above illustrations show that, apart from the simple construction, which also ensures reliable functioning, the invention permits rapid adjustment of the heel-retaining means even with only one hand, this being desirable, in particular, for ski rental purposes.

The embodiments of the invention in which an exclusive property or privilege is claimed are defined as follows:

What is claimed is:

1. A ski binding having a heel part adapted to be displaced in a longitudinal direction relative to a guide fixed to an upper side of a ski and secured in different positions, there being mounted, in a housing, a locking means which, being displaceable in the longitudinal direction, is pressed, by means of a spring, against a stop fixed to the housing and pivoted about the stop to a limited extent, the locking means having latching means receivable in mating latching means of the guide, and the locking means with its latching means being pivoted toward the mating latching means by the spring acting on said locking means at a location above the stop, and having at least one two-armed opening lever which is mounted in the housing and of which a first lever arm is provided with a hand grip and a second lever arm engages a rear end of the locking means, the locking means being pivoted away from the guide and the latching means being released when the opening lever is pivoted, the second lever arm being an essentially U-shaped member, as viewed from behind, having a connecting arm and two legs, of said lever acting at the connecting arm engaging a rear end of the locking means remote from the stop from beneath, the two legs of the opening lever extending upward from the connecting arm and are, adjacent their upper ends, pivotally supported on the housing, one leg of the opening lever having the first lever arm extending therefrom along a side of the housing, forming a leg section which, at its free end section, bears the hand grip in the form of an outwardly projecting handle extension, wherein the connecting arm is an essentially U-shaped member, as viewed in plan view, the rear end of the locking means having a bent portion engaging the U-shaped connecting arm in each position of the opening lever, and wherein the connecting arm has a bent segment extending in a direction toward the upper side of the ski, to form a supporting and protecting web which, in the latched state, terminates flush with the upper side of the guide fixed to a ski.

2. The ski binding as claimed in claim 1, wherein the locking means comprises a bearing and spring-guiding body and a locking plate, wherein the locking plate has two upright side walls which are provided with a bore for receiving a pin, the pin also passing through the bearing and spring-guiding body.

3. The ski binding as claimed in claim 1, wherein a restoring arm extends from the rear end of the locking plate, the restoring arm projecting into a free space beneath the connecting arm and is engaged by an edge of the connecting arm during a movement of the first arm of the opening lever away from the upper side of the ski.

4. The ski binding as claimed in claim 3, wherein a front end section of the locking means remote from the rear end terminates in two fork tines.

* * * * *

UNITED STATES PATENT AND TRADEMARK OFFICE

CERTIFICATE OF CORRECTION

PATENT NO. : 5,738,364

DATED : April 14, 1998

INVENTOR(S) : Johann ZOTTER et al

It is certified that error appears in the above-indentified patent and that said Letters Patent is hereby corrected as shown below:

Column 4, line 29; delete "of said lever".
line 30; delete "acting at".

Signed and Sealed this

Eleventh Day of August 1998

Bruce Lehman

*Attest:*

BRUCE LEHMAN

*Attesting Officer*

*Commissioner of Patents and Trademarks*